United States Patent [19]

Paris, Jr. et al.

[11] 4,223,708

[45] Sep. 23, 1980

[54] DOUBLE MORTISE CUTTER AND METHOD OF USING SAME

[75] Inventors: Alfonso A. Paris, Jr.; Douglas W. Muscanell, both of South Hill, Va.

[73] Assignee: New England Log Homes, Inc., Hamden, Conn.

[21] Appl. No.: 895,923

[22] Filed: Apr. 13, 1978

[51] Int. Cl.[3] ..... B27C 9/04

[52] U.S. Cl. ..... 144/326 R; 83/391; 83/467 R; 83/213; 83/471.2; 144/3 R; 144/133 R; 144/136 H; 144/82

[58] Field of Search ..... 198/339, 345; 83/391, 83/471.2, 471.3, 467, 468, 488, 266, 268, 269, 212, 213; 144/2 R, 3 R, 82, 87, 114 R, 117 R, 134 R, 136 R, 136 G, 136 H, 133 R

[56] References Cited

U.S. PATENT DOCUMENTS

| | | | |
|---|---|---|---|
| 2,917,089 | 12/1959 | Ennis | 144/3 R |
| 3,292,677 | 12/1966 | Jeppesen | 144/133 R |
| 3,470,924 | 10/1969 | Short | 144/133 R |
| 3,799,224 | 3/1974 | Vizziello et al. | 144/133 R |
| 3,813,980 | 6/1974 | Rand et al. | 83/391 |
| 3,833,033 | 9/1974 | Hurn | 144/2 R |
| 3,841,462 | 10/1974 | Schmidt | 198/339 |
| 3,865,161 | 2/1975 | Vizziello et al. | 144/134 R |
| 3,918,825 | 11/1975 | Alberti | 83/467 R |
| 4,098,310 | 7/1978 | Sanford et al. | 144/3 R |

FOREIGN PATENT DOCUMENTS

| | | | |
|---|---|---|---|
| 2416703 | 10/1975 | Fed. Rep. of Germany | 198/345 |
| 278966 | 10/1927 | United Kingdom | 144/133 R |

*Primary Examiner*—W. Donald Bray
*Attorney, Agent, or Firm*—DeLio and Montgomery

[57] ABSTRACT

A machine for cutting a rectangular mortise in either or both sides of a log intended for building construction, with means for determining accurately the spacing of each mortise from an adjacent end of the log and/or from an adjacent mortise, and the method of operating the machine to effect a plurality of spaced cuts.

7 Claims, 4 Drawing Figures

10
11
12
15
16
17
18
19
20
21
22
24
25
26
27
28
29
30
31
32
33
35
36
37
38
39
40
41
42
43
44
45
46
W
W1
W2
III
III 35
36
37
38

DOUBLE MORTISE CUTTER AND METHOD OF USING SAME

This invention relates to a machine for cutting one or more rectangular mortise slots in either or both sides of a log intended for building construction, as in log homes, the machine being provided with stops so located that cuts can be made at points accurately spaced from either end, and additional cuts can be made at points accurately spaced from the end cuts.

In the preparation of structural logs for use in making log homes and the like it is necessary to provide certain logs with mortise openings, for cooperation with the tenons on complementary logs, as at the corners of the building. While a mortise is traditionally an opening which is bounded by wood on four sides, in log building construction, mortises are formed by cutting a three-sided square notch or slot in the side of one log, the fourth side being provided by a surface of an adjacent log. The mortise openings are spaced a standard distance, e.g., one foot, from one or both ends of the log, and it may be necessary to provide also one or more additional mortise openings at intervals along the length of the log. It has heretofore been necessary to measure, mark and cut at points determined by visual observation, which is time consuming and permits the occurrence of inaccuracies.

At the point in a log production line where mortises are to be formed each log is assumed to have been planed and grooved on two opposite sides (top and bottom).

It is accordingly an object of the present invention to provide means for rapidly and accurately locating mortise cuts in either side of a log being processed and at a predetermined distance from either end.

It is a further object of the invention to provide means for locating the log in positions such that additional mortise openings can be cut at precise distances from previously cut openings.

It is another object of the invention to provide log locating means in positions to be engaged by log ends and at least one such means being engageable by an intermediate surface of the log.

It is a still further object of the invention to provide certain improvements in the form, construction and arrangement of the several parts whereby the above-named and other objects may effectively be attained.

The invention accordingly comprises the features of construction, combinations of elements, and arrangement of parts which will be exemplified in the constructions hereinafter set forth, and the scope of the invention will be indicated in the claims.

A practical embodiment of the invention is shown in the accompanying drawings wherein.

Figures 1, 3:
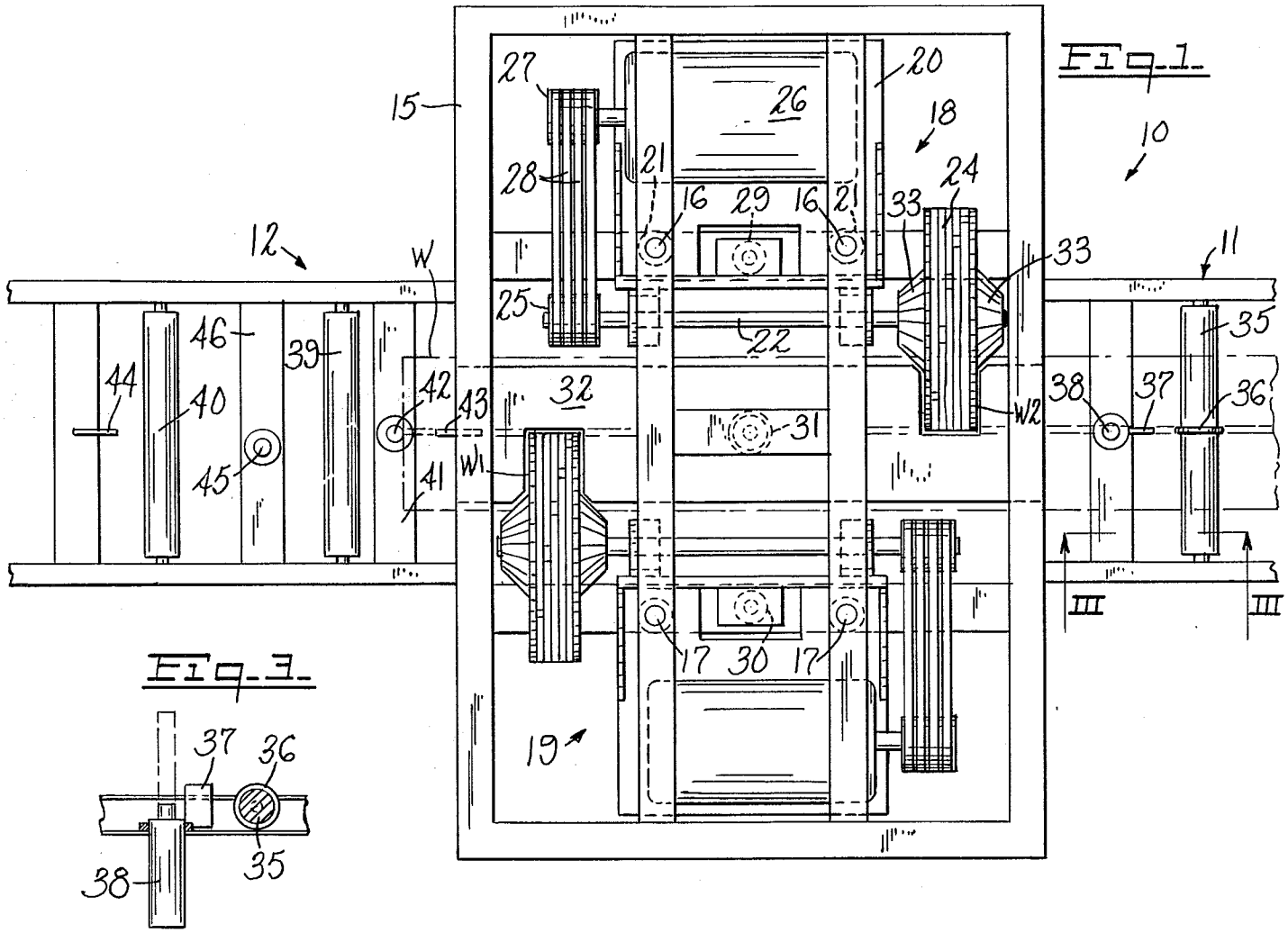
FIG. 1 represents a top plan view of the machine, with certain conventional details omitted and the feed and delivery tables broken away.
FIG. 3 represents a detail vertical section on the line III—III of FIG. 1.
Figure 2:
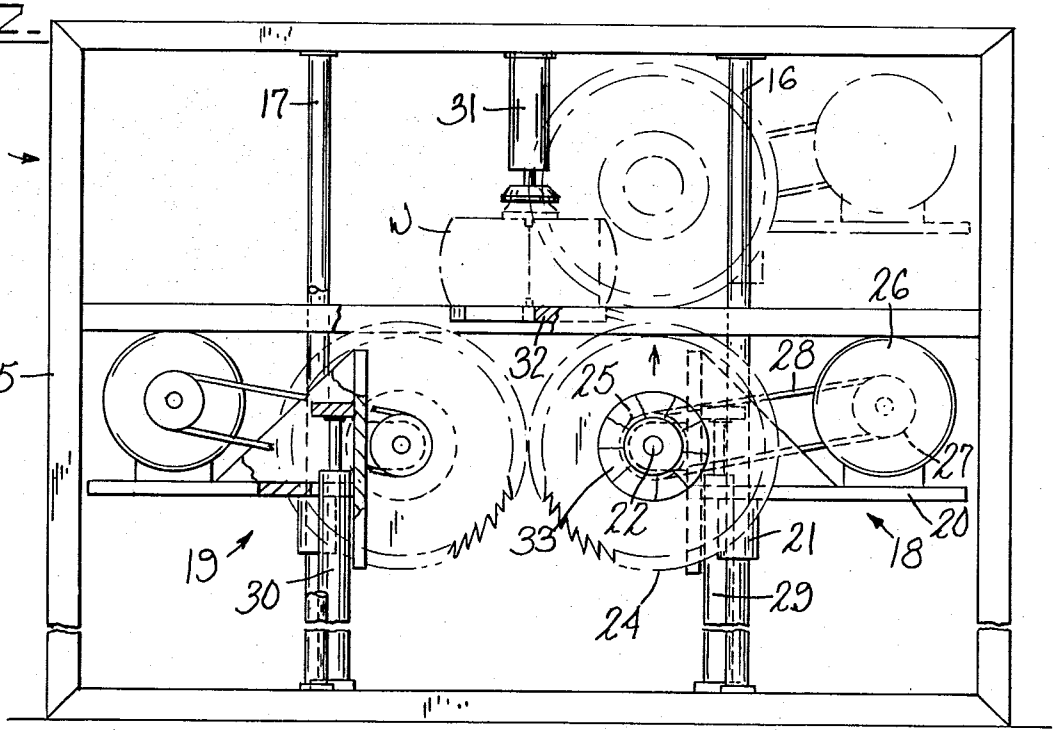
FIG. 2 represents a somewhat diagrammatic end view of the machine with the saws in their rest position, the raised position of one saw being shown in broken lines.

Referring to the drawings, the machine is shown as being double-ended and, in most respects, reversible with respect to its position in the line of flow of workpieces through a mill. This provides great versatility, as will appear below. For purposes of description the machine 10 will be described as receiving the workpieces from a feed table 11, on the right in FIGS. 1 and 4, and delivering them across the delivery table 12, at the left of FIGS. 1 and 4.

The generally rectangular machine frame 15 is provided with two pairs of vertical tracks 16, 16, 17, 17, each pair serving for the vertical guidance of one of the saw assemblies 18, 19. Since the latter are identical and radially symmetrical, only one need be described in detail as to its mechanical elements, whereas each is adapted to perform individual functions in the overall mortise forming operation. The saw assembly 18 comprises a platform 20 slidably mounted on the tracks 16, 16 by means of the tubular sleeves 21, 21, a drive shaft 22 carried in journals 23, 23 fixed to the platform, a dado head 24 on one end of the shaft and adapted to cut a rectangular notch or groove in material in its path, a pulley assembly 25 on the other end of the shaft and a motor 26 having a pulley assembly 27, the pulleys 25 and 27 being connected by the belts 28. Vertical movement of the saw assembly 18 is effected by means of the hydraulic or pneumatic jack 29, the opposite (identical) saw assembly 19 being raised and lowered by the jack 30. In the middle of the machine is a pneumatic clamp 31, adapted to hold the log down on a support 32 during the saw operation.

While the dado head alone cuts a satisfactory rectangular notch or groove to a predetermined bottom line (e.g., to the center line or longitudinal groove line of the log) the actual depth depends on the thickness of the log at that point. It is therefore advisable to supplement each dado head with bevel cutters 33, 33 so that the rectangular cut has a constant depth and any additional depth is beveled, to adapt readily to a similarly formed tenon on a cooperating log.

The feed table 11 comprises a frame having a series of idle rolls like the roll 35, with or without annular guide ridges such as ridge 36 to engage in the longitudinal bottom groove of a log to be mortised. Between the last roll 35 and the saw frame 15 is a fixed guide plate 37, the edge of which fits in the groove of an advancing log, and a pneumatically actuated stop pin 38 which can be selectively raised to engage the end of a log and arrest its movement. The stop 38 is useful for stopping the rearward movement of a log which has been advanced entirely past the stop, as will be explained below.

The delivery table 12 also comprises an elongated frame having rollers such as the first two shown at 39 and 40 and cross bars at suitable intervals. The first crossbar 41 is provided with a pneumatic stop 42 (like 38) on the center line of the machine and in line with the fixed guide plate 43 on the machine frame, and one or more fixed guide plates 44 are carried by cross-bars at intervals along the length of the table. Another pneumatic stop 45 is mounted on the cross-bar 46, offset sufficiently from the center line to permit the stop pin to enter a previously cut mortise if the latter is brought into register with the stop.

The dado heads can be actuated simultaneously or separately as to rotation and/or position and the several stops 38, 42 and 45 can also be activated individually, as required. The clamp 31 may be independently operated or may be coordinated with the movement of the dado heads as a precaution against sawing a loose log.

Logs to be mortised have planed and groove parallel top and bottom surfaces. The grooves are designed to receive splines which fix the relation of vertically superimposed logs in the wall of a house, and any mortise formed in such a log is designed to terminate in the plane of the longitudinal grooves, as clearly appears in FIGS. 1 and 4 where a log W is shown, in broken and in full lines, respectively.

According to FIG. 1 the log has been advanced past the stop 38 (not actuated) to the stop 42, at a distance of one foot beyond the dado head in assembly 19. This dado head has been actuated to cut a mortise $W^1$ in the left side of the log (left, facing in the direction of movement of the log from the feed table). If a mortise is needed in the right side of the log, it can be cut by the dado head 24, as shown at $W^2$. If a mortise is needed at a point adjacent the rear end of the log, the log is fed through the machine until its rear end has passed the stop 38 which is then raised, the log moved back against it and the assembly 18 actuated to make a cut like $W^2$.

Figure 4:
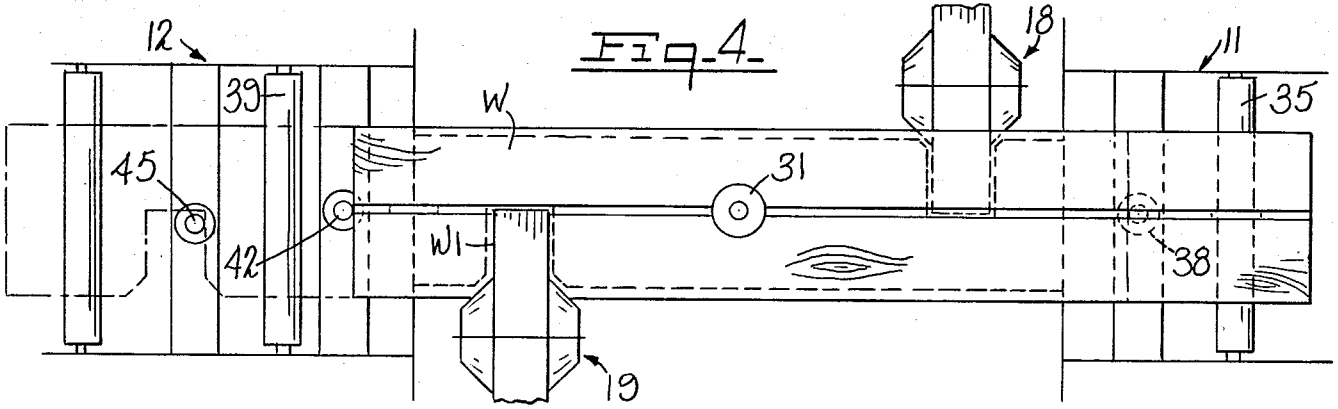
FIG. 4 represents a diagrammatic plan view of a workpiece in the machine, the provision for cutting a plurality of mortises at accurately spaced intervals being illustrated at the left of the Figure.

There are occasions when two or more mortises need to be cut at one foot intervals along one side of a log. This is illustrated at the left of FIG. 4 where the stop 42 has been lowered and mortise $W^1$ has been moved to a point where it can be engaged by stop 45. The latter is spaced ten inches from stop 42, so that the proper spacing can be assured if the log is moved to bring the rear wall of mortise $W^1$ to bear against the stop pin as shown. This operation can be repeated to form as many mortises as may be needed.

It is essential for this machine to be instantly adaptable to the production of specifically different logs, because log buildings are modular, each one being constructed from a specified set of logs pre-cut to fit together according to plan. The machine operators work from a chart which tells them exactly what operations have to be performed on each log, and the logs are marked to indicate how many mortises are to be cut in which locations. One or more log handlers attend to the positioning of the logs, in constant cooperation with the operator at a control console, charged with actuation of saws, stops, clamp, etc. Such controls are, in general, conventional and are not shown. However, the provision of hydraulic or pneumatic actuating means for such parts as the log stops represents a significant improvement over hand operation of similar devices, both in speed and in safety.

It will thus be seen that the objects set forth above, among those made apparent from the preceding description, are efficiently attained and, since certain changes may be made in the above constructions without departing from the spirt and scope of the invention, it is intended that all matter contained in the above description or shown in the accompanying drawings shall be interpreted as illustrative and not in a limiting sense.

We claim:

1. A mortising machine comprising a frame having upstream and downstream ends, a pair of radially symmetrical vertically movable supports, means on the frame for guiding the supports, each support carrying a dado head mounted on a horizontal axle, a feed table upstream of the frame and having means for guiding a grooved log on a path parallel to the axles of both dado heads, a delivery table downstream of the frame and having means for guiding a grooved log in the same line as the feed table, a first vertically movable log engaging stop located downstream of the paths of both dado heads in the direction of movement of a log from the feed table to the delivery table, a second vertically movable log engaging stop located between the feed table guide means and the paths of both dado heads, independently operable means for moving either stop into and out of log holding position, and independently operable means for moving either dado head support into and out of operative position, the cutting face of each dado head being guided on a path corresponding substantially to a vertical plane through the center line of the log and said dado heads being disposed on opposite sides of said plane.

2. A mortising machine according to claim 1 wherein the engaging stops are located substantially in said vertical plane.

3. A mortising machine according to claim 1 which includes a third vertically movable log engaging stop located beyond the first named stop in the same direction and offset from said vertical plane on the same side thereof as the nearer dado head, and means for moving said additional stop into and out of operative position.

4. A mortising machine according to claim 1 wherein all the means for moving respective element are pneumatic.

5. The method of forming a plurality of spaced notches in one side of an elongated workpiece which includes, providing a movable cutting device adapted to cut a notch in one side of an elongated workpiece, providing guide and support means to permit longitudinal movement of the workpiece across the cutting path of the cutting device, providing a first stop and means to move the stop into and out of a position to engage an advancing end of the workpiece, providing a second stop and means to move the second stop into and out of a position to engage in a notch in the workpiece, moving the first stop into stop position, advancing an elongated workpiece rectilinearly to engage its end against the first stop, actuating the cutting device to cut a first notch in one side of the workpiece, moving the first stop out of stop position, advancing the workpiece rectilinearly to bring the first notch into register with the second stop, moving the second stop into notch engaging position, and actuating the cutting device to cut a second notch in said one side of the workpiece.

6. The method of claim 5 which includes the step of moving the workpiece to bring one wall of the first notch firmly against the second stop.

7. The method of claim 5 wherein the cutting device is a dado head adapted to cut notches having parallel flat side faces.

* * * * *